US011518001B2

(12) United States Patent
Zulauf et al.

(10) Patent No.: US 11,518,001 B2
(45) Date of Patent: Dec. 6, 2022

(54) BACKING PAD ASSEMBLY WITH ANTI-ROTATIONAL LOCKING FEATURE FOR RESIN FIBER DISCS

(71) Applicant: Weiler Corporation, Cresco, PA (US)

(72) Inventors: Michael Zulauf, Canadensis, PA (US); Richard Hopkins, Clarks Summit, PA (US)

(73) Assignee: Weiler Corporation, Cresco, PA (US)

( * ) Notice: Subject to any disclaimer, the term of this patent is extended or adjusted under 35 U.S.C. 154(b) by 901 days.

(21) Appl. No.: 16/279,605

(22) Filed: Feb. 19, 2019

(65) Prior Publication Data

US 2019/0255678 A1 Aug. 22, 2019

Related U.S. Application Data

(60) Provisional application No. 62/632,529, filed on Feb. 20, 2018.

(51) Int. Cl.
*B24D 11/02* (2006.01)
*B24D 13/20* (2006.01)

(52) U.S. Cl.
CPC ..... *B24D 13/20* (2013.01); *B24D 11/02* (2013.01)

(58) Field of Classification Search
CPC ..... B24D 11/02; B24D 13/20; B24D 7/16; B24D 5/16; B24D 9/08; B24D 9/085; B24B 45/00; B24B 23/022; B24B 45/006; B24B 23/02
USPC ..... 451/512, 510, 515, 490
See application file for complete search history.

(56) References Cited

U.S. PATENT DOCUMENTS 2,997,819 A * 8/1961 Schacht ..... B24D 9/085 451/510
3,157,010 A 11/1964 Block
3,436,875 A * 4/1969 Cheney ..... B24D 9/085 451/508
3,667,169 A * 6/1972 MacKay, Jr. ..... B24D 7/16 451/511

(Continued)

FOREIGN PATENT DOCUMENTS

EP 0237856 A2 9/1987

OTHER PUBLICATIONS

PFERD COMBICLICK® Backing Pad and Abrasive Resin Disc, https://www.pferdusa.com/producs/204a/204a12P.html; (2018) 4 pages.

*Primary Examiner* — Joseph J Hail
*Assistant Examiner* — Arman Milanian
(74) *Attorney, Agent, or Firm* — Faegre Drinker Biddle & Reath LLP

(57) ABSTRACT

An abrasive disc mounting assembly for attaching an abrasive disc to a rotary motor drive. The assembly includes a backing pad with a front face and a rear surface. A tapered recess is formed in the front face and extends into the backing pad, the recess having a flat base at its inward end. A hole is formed in the recess and extends through the backing pad from the base to the rear surface. The hole is centered within the recess. A grinder spindle is sized to fit within the hole. The spindle has threads formed on one end. The assembly also includes a nut with a shape that is complementary to the shape of the recess so that the nut seats within the recess. The recess and nut include anti-rotational features that prevent one from rotating relative to the other as the nut seats within the recess.

24 Claims, 7 Drawing Sheets

(56) References Cited

U.S. PATENT DOCUMENTS

| | | | | |
|---|---|---|---|---|
| 3,765,130 | A | 10/1973 | Block | |
| 5,339,571 | A | 8/1994 | Timmons et al. | |
| 5,538,464 | A * | 7/1996 | MacKay, Jr. | B23P 19/062 451/342 |
| 5,895,317 | A | 4/1999 | Timm | |
| 5,938,514 | A | 8/1999 | Amin et al. | |
| 6,142,858 | A | 11/2000 | Luedeke | |
| 6,277,012 | B1 * | 8/2001 | Halliley | B24B 23/02 451/359 |
| 6,371,837 | B1 | 4/2002 | Luedeke | |
| 6,454,639 | B1 * | 9/2002 | Huber | B24D 5/16 451/342 |
| 6,490,750 | B2 | 12/2002 | Shia et al. | |
| 6,530,828 | B1 | 3/2003 | Kolthoff | |
| 7,056,200 | B2 | 6/2006 | Nelson | |
| 8,408,974 | B2 | 4/2013 | Farber et al. | |
| 8,425,282 | B2 | 4/2013 | Woods et al. | |
| 2006/0019579 | A1 * | 1/2006 | Braunschweig | B24D 9/08 451/28 |
| 2007/0141970 | A1 | 6/2007 | MacKay | |
| 2008/0248733 | A1 | 10/2008 | Mueller et al. | |
| 2015/0273658 | A1 | 10/2015 | Godreau | |

* cited by examiner

BACKING PAD ASSEMBLY WITH ANTI-ROTATIONAL LOCKING FEATURE FOR RESIN FIBER DISCS

RELATED APPLICATION

This application is related to and claims the benefit of U.S. Provisional Patent Application No. 62/632,529, filed on Feb. 20, 2018, the disclosure of which is incorporated herein by reference in its entirety.

FIELD OF THE INVENTION

The present invention relates to abrasive resin fiber discs and, more particularly, to a tool-free, anti-rotational locking design to affix a fiber backed coated abrasive disc (RFD) onto a backing pad.

BACKGROUND

Disposable abrasive fiber discs are used for many applications, including the finishing of surfaces. The abrasive discs used in finishing operations are generally flexible so as to minimize cost and permit close contact with the surface contours. The abrasive disc generally comprises a fiber substrate that has one side coated with an abrasive material, such as aluminum oxide in a resin binder. Since the fiber disc lacks significant stiffness, a support is typically used between the substrate and the rotary mount. The most common support is a circular backing pad composed of composite, plastic or rubber.

In use, a spindle, which is a part of a rotating tool (such as a hand held right angle grinder), extends through a center hole in the backing pad and abrasive disc. A flange nut is threaded onto the end of the spindle to clamp the RFD onto the backing pad. Since the backing pad has a generally flat face, the abrasive fiber disc lies on the plane of the backing pad face. As such, the flange nut that attaches to the spindle is located on top of the RFD working surface. This can lead to contact between the flange nut and the surface being finished leading to damage of the substrate.

Additionally, conventional flange nuts require the use of a special tool to secure them to the spindle, which makes mounting more complex and time consuming.

A need exists to eliminate this interference of the flange nut during grinding when using abrasive fiber discs at low angle and flat grinding orientation.

SUMMARY OF THE INVENTION

The present invention provides a tool-free, self-orienting, anti-rotational mounting assembly for affixing a fiber backed coated abrasive disc onto a rotary motor drive. The assembly includes a backing pad with a front face and a rear surface. A polygon (three sided or more) shaped tapered recess is formed in the front face and extends into the backing pad. The recess has a flat base at its inward end, angled sides, and a hole formed in the recess and passing through the backing pad from the base to the rear surface. The hole is centered within the recess.

A grinder spindle is sized to fit within the hole. The spindle has threads formed on one end.

A polygon (three sided or more) shaped tapered nut is provided with a base, angled sides and a face. The polygon shape of the tapered nut is complementary to the polygon shape of the tapered recess such that the tapered nut seats within the tapered recess when installed with the face of the nut located inside the recess relative to the face of the backing pad. The nut has internal threads that mate with the threads on the spindle.

An abrasive resin fiber disc is removably mounted to the backing pad with the tapered nut. The disc has abrasive material disposed on one side. A hole is formed through the abrasive disc. A plurality of slits are cut into the abrasive disc and extend radially away from the hole. The number of slits preferably corresponds to the shape and orientation of the nut. The slits define tabs spaced around the hole. When the nut is threaded onto the spindle and in the recess, the tabs are located between the sides of the nut and the sides of the recess thereby securing the disc to the backing pad.

In a preferred embodiment, the tapered recess and the tapered nut are each in the shape of a truncated square pyramid.

In an embodiment, the recess has an opening on the face of the backing pad with sides of about 1.88 inches and the base of the opening has sides of about 0.88 inches. The opposed sides of the tapered nut are about 1.54 inches apart on the top of the nut and about 0.88 inches apart on the bottom of the nut, and when the nut is seated in the recess, the face of the nut sits below the abrasive face of the RFD and the face of the backing pad.

In an embodiment, the opposed sides of the tapered recess define an inclusive angle of about 93.18 degrees, and wherein the opposed sides of the tapered nut define an inclusive angle of about 86 degrees and is about 0.32 inches thick.

In an embodiment, the recess has an opening on the face of the backing pad with side dimensions of between approximately 1.50 inches and approximately 2.00 inches and the base of the opening has side dimensions of between approximately 0.625 inches and approximately 1.00 inch. The opposed sides of the tapered nut are between approximately 1.50 inches and approximately 2.00 inches apart on the top of the nut and between approximately 0.625 inches and approximately 1.00 inch apart on the bottom of the nut. The opposed sides of the tapered recess define an inclusive angle of between approximately 45 degrees and approximately 155 degrees, and the opposed sides of the tapered nut define an inclusive angle of between approximately 45 degrees and approximately 155 degrees, and is about 0.32 inches thick.

The tapered nut may be made from plastic material and the internal threads may be formed on an insert mounted to the nut.

The backing pad may include a pad core made from a rigid material surrounded by an annular ring made of rubber, plastic, composite or other material with a portion of the ring defining a portion of the face of the backing pad. The pad core may be made from metal, plastic or composite material. The tapered recess is preferably formed in the pad core. It is also contemplated that the backing pad can be made from a single piece of material.

The ring may include raised support ridges that extend radially outward along the face of the ring from an inner portion of the ring to an outer portion. The ridges may be curved, shaped or oriented in a direction away from the intended direction of rotation of the assembly during use.

The tapered nut may include a plurality of alignment pins that extend from a side of the nut opposite from the face of the nut. The recess may include a plurality of alignment holes formed in the base, the alignment holes positioned to align with the pins so that the pins can be inserted into the alignment holes during installation of the nut on the backing pad.

In another embodiment, an abrasive disc mounting assembly for attaching an abrasive disc to a rotary motor drive is disclosed. The assembly includes a backing pad with a front face and a rear surface. The backing pad has a pad core made from a rigid material surrounded by an annular ring constructed of rubber, plastic or other material with a portion of the ring defining a portion of the face of the backing pad. A polygon shaped tapered recess is formed in the pad core on the front face side of the backing pad. The tapered recess has angled sides that extend into the pad core and a flat base at its inward end. A hole is formed in the recess and passes through the pad core from the base to the rear surface. The hole is centered within the recess. The angled sides of the tapered recess each form an angle relative to a center axis of between approximately 22.5 degrees and 77.5 degrees.

A grinder spindle is sized to fit within the hole in the pad core, the spindle having threads formed on one end.

A polygon-shaped tapered nut is provided and has a base, angled sides and a face. The polygon-shape of the nut is complementary to the polygon shape of the tapered recess such that the tapered nut seats within the tapered recess when installed with the face of the nut located inside the recess relative to the face of the backing pad. The nut has internal threads that mate with the threads on the spindle. The angled sides of the tapered nut each form an angle relative to a center axis of between approximately 22.5 degrees and 77.5 degrees.

In another embodiment, an abrasive disc mounting assembly is disclosed for attaching an abrasive disc to a spindle on a rotary motor drive. The assembly includes a backing pad with a front face and a rear surface. A recess is formed in the front face and extends into the backing pad and has a base at its inward end, sides, and a hole formed in the recess and passing through the backing pad from the base to the rear surface, the hole being centered within the recess. A nut is provided that has a base, sides and a face. The shape of the nut is complementary to the shape of the recess such that the nut seats within the recess with the face of the nut located inside the recess relative to the face of the backing pad. The nut has internal threads that are adapted to mate with threads on the spindle. The nut and the recess include mating anti-rotational features. The anti-rotational features prevent relative rotation between the nut and the recess thereby providing a defined way for the nut to mate with the recess.

In one configuration, the anti-rotational features are polygon-shaped sides on the nut and recess. In another configuration, the anti-rotational features are non-uniform shaped sides on nut and recess. In a further optional embodiment, the anti-rotational features are a key and a mating slot, one of the key and slot being formed on the side of the nut and the other of the key or the slot being formed on the side of the recess. In yet another configuration, the anti-rotational features are at least one pin and at least one mating hole. One of the pin and hole is on the nut and the other of the pin and hole is on the recess.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DESCRIPTION OF THE PREFERRED EMBODIMENTS

Figure 1A:
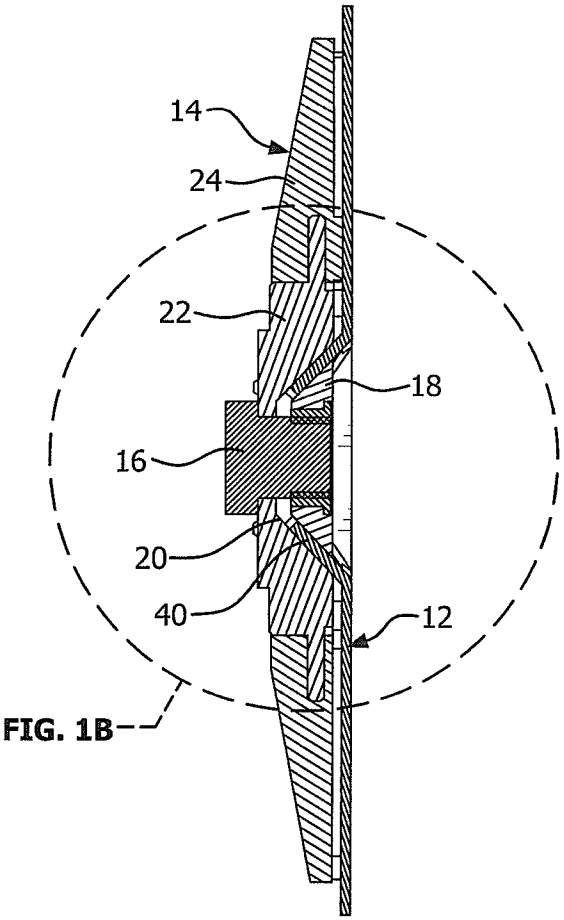
FIG. 1A is a cross-sectional view of the backing pad assembly and fiber disc of FIG. 1 taken along lines 1A-1A.
Figure 1:
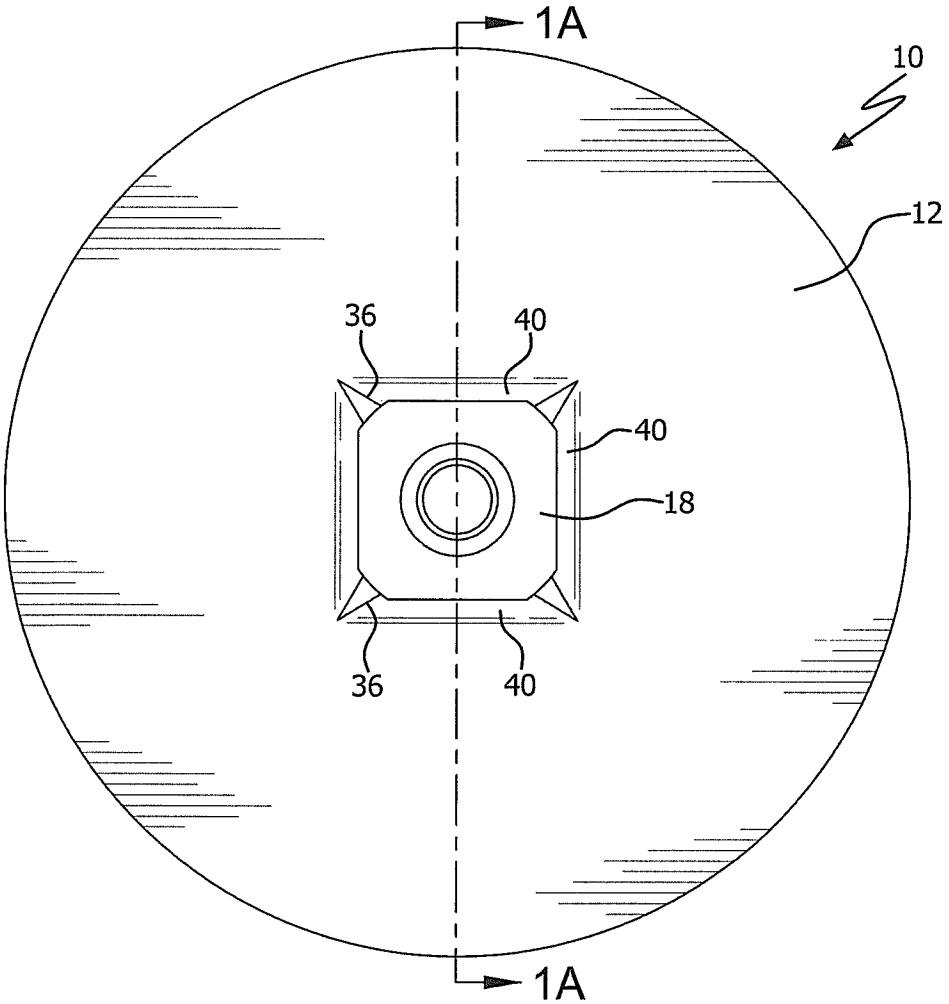
FIG. 1 is a front view of a pyramidal backing pad assembly with a resin fiber disc according to the present invention.
Figure 1B:
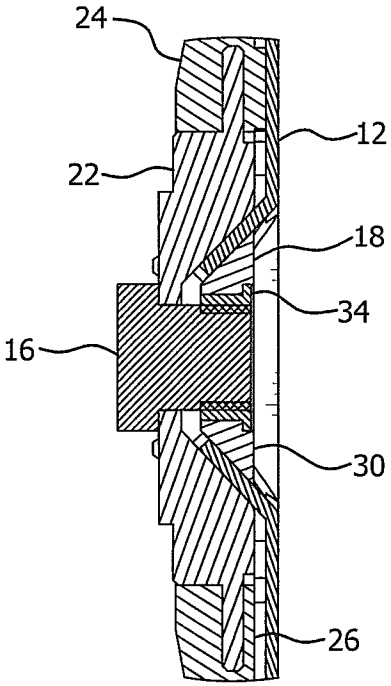
FIG. 1B is an enlarged view of a portion of the cross-section of FIG. 1A.
Figure 5:
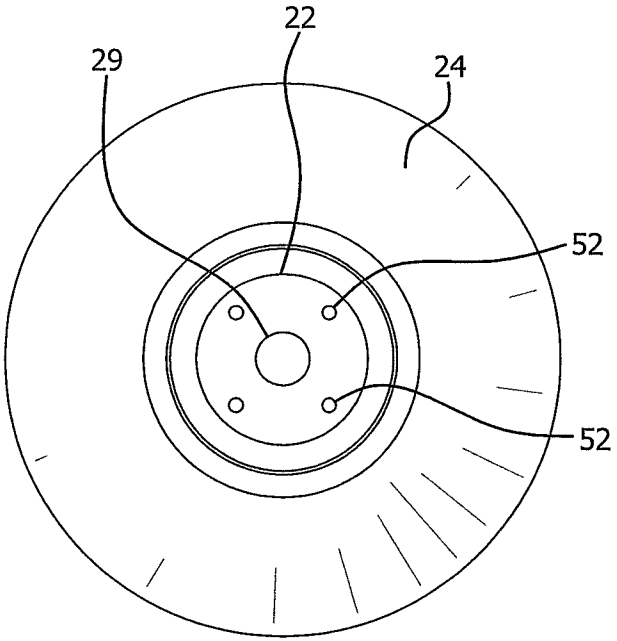
FIG. 5 is a rear view of the backing pad of FIG. 3.
Figure 4:
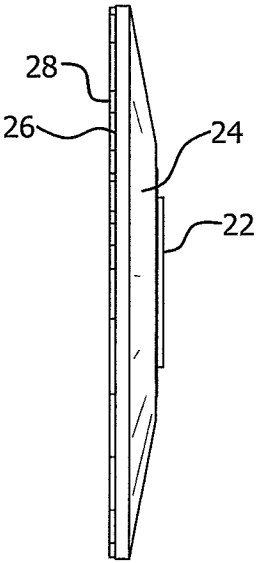
FIG. 4 is a side view of the backing pad of FIG. 3.

Referring to FIGS. 1 and 1A, a rotary fiber disc assembly 10 according to the present invention is shown and includes an abrasive resin fiber disc 12 mounted on a backing pad 14 (FIG. 1A). The assembly is intended for mounting to a motor drive (not shown) for use in rotational abrasive machining, grinding or finishing. A grinder spindle 16 (FIG. 1A) and a polygon-shaped tapered nut 18 are used to attach the abrasive disc 12 to the backing pad 14. As shown in FIGS. 1A and 1B, and discussed in more detail below, the backing pad 14 has a polygon-shaped tapered recess 20 into which a portion of the abrasive disc 12 and nut 18 seat. As used herein, the term polygon refers to a recess or nut with three or more sides.

In addition, as used herein the term "anti-rotational features" means mating shapes that prevent rotation, such as, but not limited to, a polygon-shaped nut and recess, a non-uniform (e.g., non-conical taper) shaped nut and recess, or a conical shaped nut and recess with locking features, such as a key or pins, that mate with a complementary features, such as slots or holes, to prevent relative rotation between the nut and the recess thereby providing a defined way for the nut to mate with the recess.

Figure 2:
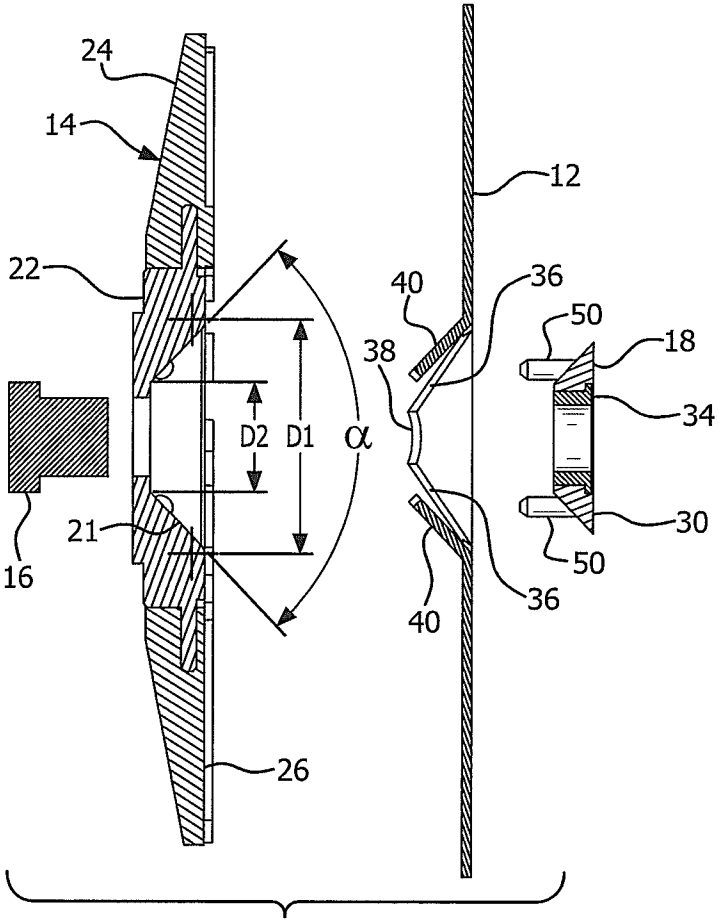
FIG. 2 is an exploded view of the backing pad assembly and fiber disc of FIG. 1.
Figure 3:
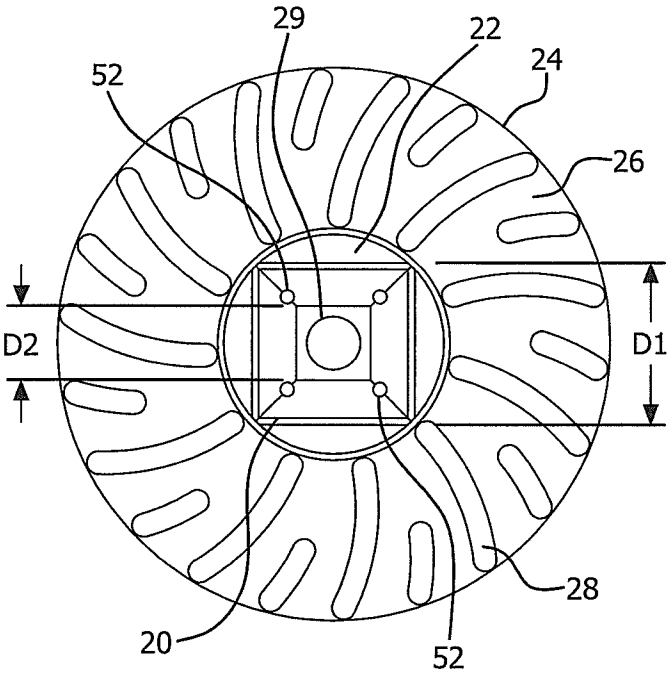
FIG. 3 is a front view of the backing pad of FIG. 1.

Turning now to FIG. 2, which is an exploded view of the cross-section of the assembly 10 of FIG. 1A, the backing pad 14 is shown in more detail. The backing pad 14 includes a pad core 22, preferably made from a relative stiff material, such as metal, plastic or composite material, and an outer support ring 24, preferably made from a flexible material, such as rubber, plastic or composite material. The outer rubber ring 24 is preferably molded onto the pad core 22. The recess 20 is formed in the pad core 22. Referring now to FIG. 3, which is a front view of the face 26 of the backing pad, the polygon-shaped tapered recess 20 is preferably in the shape of an inverted truncated square pyramid with equal sides and a flat top (i.e., bottom of the recess). The sides of the recess 20 preferably define an opening D1 on the face 26 of the backing pad and a base dimension D2. In one embodiment the side opening dimension D1 is about 1.88 inches and the base dimension D2 is about 0.88 inches. As will become more apparent below, the combination of the side opening dimension D1 and the base dimension D2, and the resulting pyramid shaped angular side walls 21 must allow sufficient area for the pad 14 and nut 18 to securely trap tabs 40 formed on the RFD (discussed below) while also allowing the face 30 of the nut 18 to be recessed below the grinding surface (FIG. 1B). In a preferred embodiment, the side opening dimension D1 is between approximately 1.50 inches-2.00 inches and the base dimension D2 is between approximately 0.625 inches-1.00 inch. The grinder spindle diameter defines the minimum bottom square size D2. The sides of the recess preferably define an inclusive angle α of about 93.18 degrees. Preferably the angle α is in a range between approximately 45 degrees to 155 degrees. More preferably between approximately 75 degrees to 110 degrees.

The face 26 of the support ring 24 preferably includes raised support ridges 28 which contact the back of the abrasive fiber disc. The ridges 28 extend radially outward along the face 26 of the backing molded ring from an inner portion of the ring to an outer portion and preferably have a curvature away from the direction of rotation of the disc as shown. The curved ridges are designed to allow cooling air to circulate between the back of the resin fiber disc and the voids in the surface of the support ring that are created by the ridges as the tool is used. The ridges are about 0.07" high (off the face of the backing pad) to provide a sufficient gap for air to pass will still allowing the entire pad to provide support. The present invention is not limited to the inclusion of ridges. Instead, the ridges could be eliminated resulting in a smooth flat face of the backing pad or the ridges could be straight instead of curved.

While the recess 20 is shown shaped as a square pyramid, it could also be formed as any polygonal tapered shape, such as a triangular, pentagonal, or hexagonal pyramid as long as adequate strength is maintained with respect to the resin fiber disc tabs (referred to below). The key is that the shape serves as both an alignment feature for positioning the RFD and the pyramid nut 18 correctly, as well as creates a torsional lock to fasten the RFD and the pyramid nut 18 and backing 14 onto the motor spindle, without tools. In additional the present invention allows for the positioning of the polygonal nut 18 below the work surface of the RFD 12.

Figure 7:
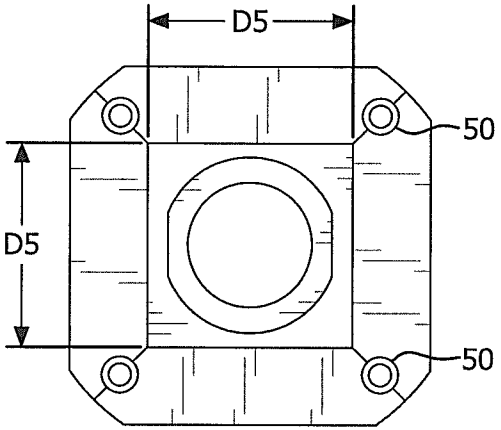
FIG. 7 is a rear view of the pyramid nut of FIG. 6.
Figure 6A:
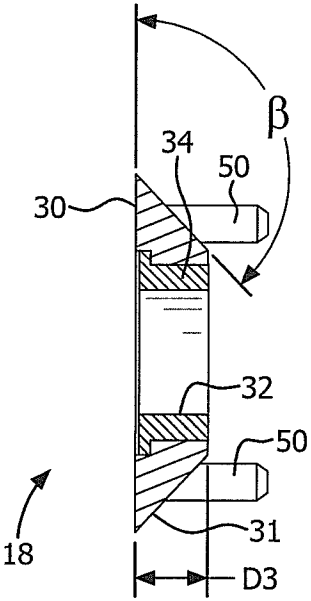
FIG. 6A is a cross-sectional view of the pyramid nut of FIG. 6 taken along lines 6A-6A.
Figure 6:
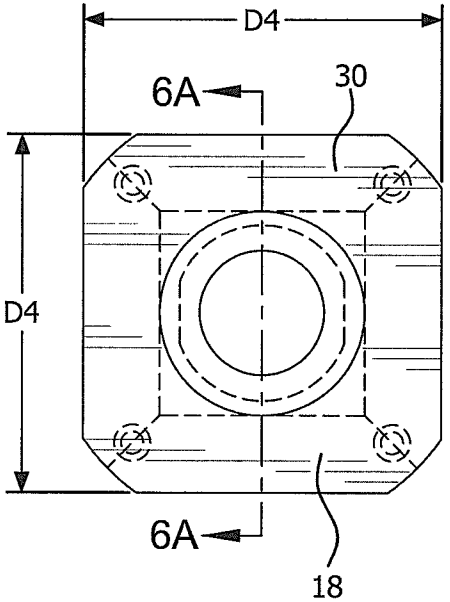
FIG. 6 is a front view of a pyramid nut in the backing pad assembly of FIG. 1.

As mentioned above, the abrasive fiber disc 12 is mounted to the backing pad 14 through the use of a pyramid shaped nut 18. A preferred embodiment of the nut 18 is shown in FIGS. 6, 6A and 7. In that embodiment, the nut 18 is in the shape of an inverted square pyramid with a flatten top (which is the bottom of the nut). The four angular sides of the nut 18 are configured to seat within and generally mate with the recess 20. In the preferred embodiment, the nut has an angular side β of approximately 137 degrees, a depth D3 of about 0.32 inches, a top dimension D4 of about 1.54 inches and a bottom dimension D5 of about 0.88 inches. In a preferred embodiment, the top dimension D4 is between approximately 1.50 inches-2.00 inches and the bottom dimension D5 is between approximately 0.625 inches-1.00 inch. Preferably the angle β is in a range between approximately 45 degrees to 155 degrees. More preferably between approximately 75 degrees to 110 degrees. It should be readily apparent that the dimensions between the nut 18 and the recess 20 should be complementary.

As such, when the nut 18 is sitting in the recess 20, the face 30 of the nut 18 sits below the surface of the face 26 of the backing pad 14 as shown in FIG. 1B. Of course, if the recess 20 has a different polygonal shape as discussed above, the nut preferably has a complementary shape. For example, if the shape of recess 20 and the nut 18 are not square as shown, but other pyramidal shapes, such as triangular, then the angles of each side relative to the center (rotational) axis should each have an angle between approximately 22.5 degrees and 77.5 degrees, or more preferably between approximately 37.5 degrees and 55 degrees (i.e., one half of the inclusive angles α and β discussed above.) The nut 18 has internal threads 32 that engage with mating threads on the spindle 16. In the illustrated embodiment, the internal threads 32 are formed on an insert 34 that is attached to or press fit into the nut 18. It should be apparent that an insert is not necessary in the invention and, thus, the threads 32 can be formed directly in the nut. The center of the backing pad 14, and more specifically the center of the recess includes a non-threaded hole 29 that extends through the pad core 22 for receiving the spindle and is sized so as to allow the backing pad 14 to spin freely about the spindle except when the nut is attached and fully seated, thereby tightly securing an RFD. This permits the assembly to center on the spindle.

Figure 10:
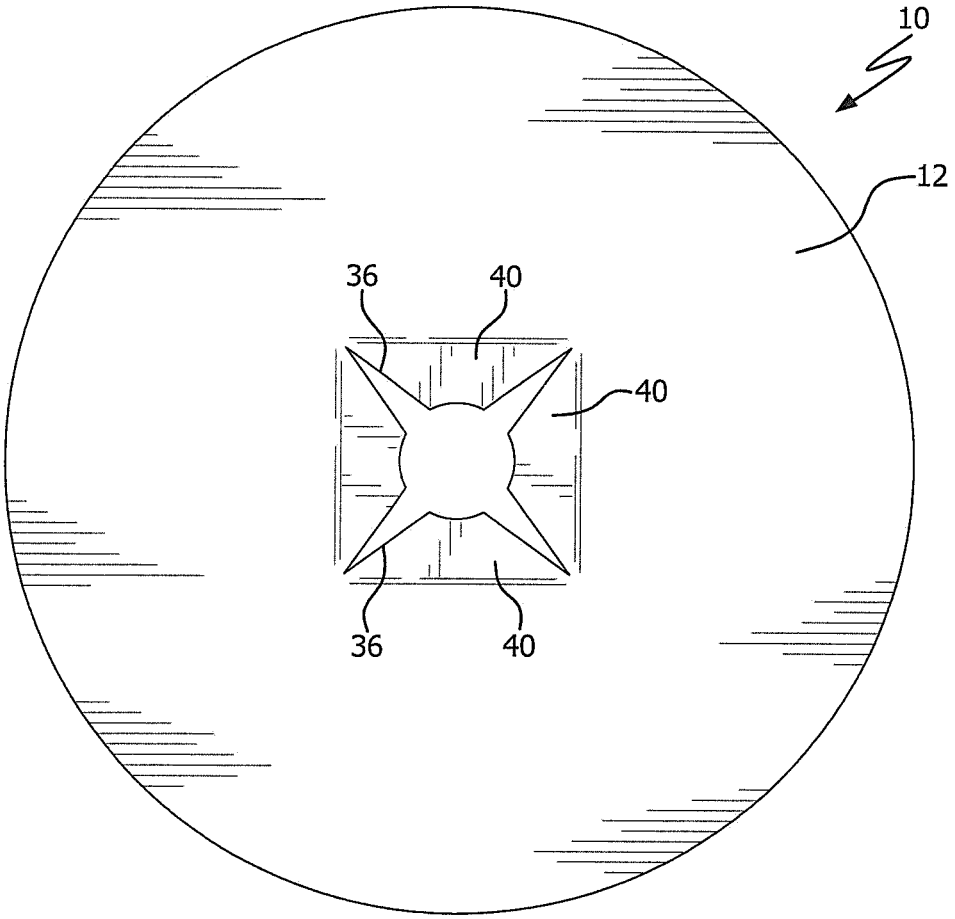
FIG. 10 is a front view of a resin fiber disc according to an embodiment of the invention.

Referring to FIG. 10, an abrasive resin fiber disc 12 according to one embodiment is shown. To facilitate attachment of the RFD 12 to the backing pad 18, the center of the disc 12 includes a circular hole 38 and four slits 36 spaced evenly about the hole 38 and extending generally outward from the hole, preferably radially. The inclusion of the slits forms tabs 40 on the inner portion of the disc 12 around the hole. As such, when the nut 18 is tightened into the recess 20, it causes the tabs 40 to bend into and generally conform to and be captured between the angled sides 21 of the recess 20 and the angled side 31 of the nut 18 as shown in FIGS. 1A and 1B. This locks the abrasive fiber disc 12 to the backing pad 14 when the nut 18 is in the recess and installed on the spindle 16.

The use of a polygon shaped recess 20 and nut 18 combination eliminates the need for any tool to facilitate installation and removal of the RFDs. When the polygon shaped nut 18 is threaded onto the spindle, its polygon shaped surfaces on the nut contact the corresponding sides on the recess 20, thereby preventing the nut from rotating relative to the backing pad 14. Since, as discussed above, the backing pad 14 is free to rotate on the spindle, the grinder spindle is locked to prevent it from turning. The assembly 10 (backing pad, disc, pyramid nut) is rotated around the spindle, causing the pyramidal nut 17 to thread further on the spindle and seating deeper into the recess 20, flaring or bending the tabs 40 as they are captured between the angled sides 21, 31 of the recess and the nut, thereby securing the abrasive disc to the backing pad.

Figure 8:
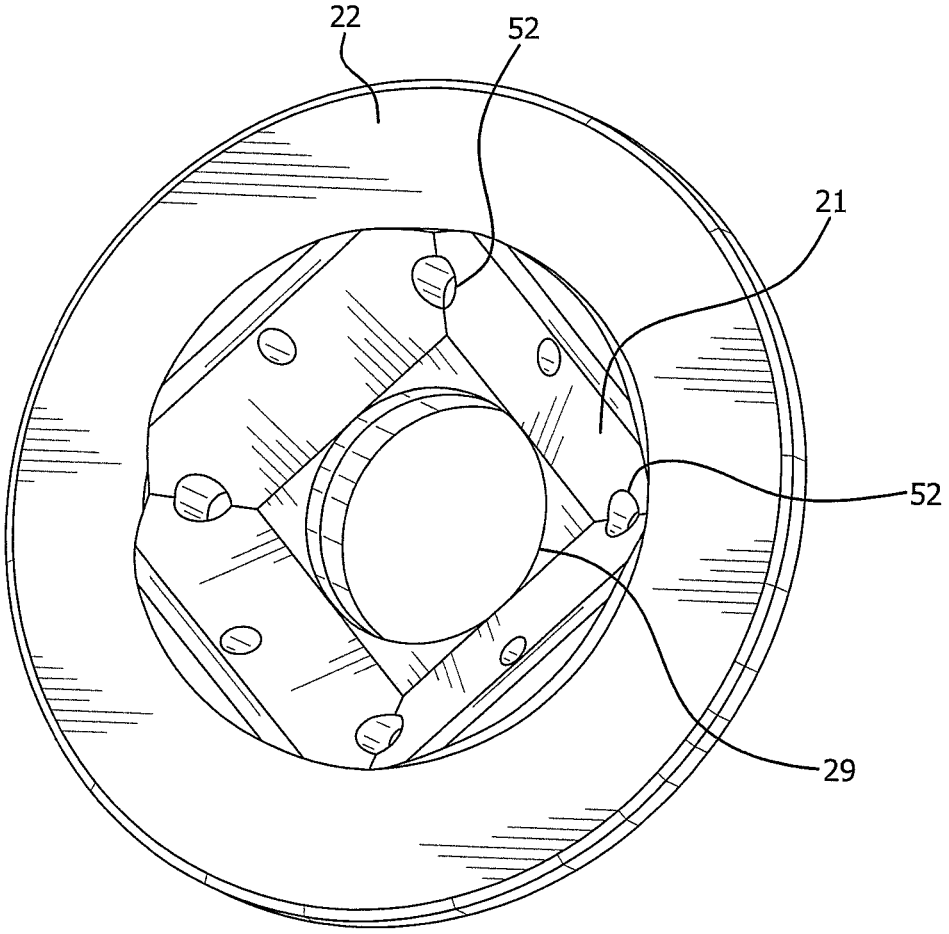
FIG. 8 is a front perspective view of a backing pad core according to one embodiment of the invention.

It is contemplated that centering pins 50 may be added to the nut 18 as shown in FIG. 6A, along with corresponding alignment holes 52 formed in the core 22 (FIG. 8). The centering pins 50 and holes 52 act as mating anti-rotational features on the nut and recess which, when engaged, prevent relative rotation between the nut and the recess thereby providing a defined way for the nut to mate with the recess. In the event that the anti-rotational features are used, the shape of the nut and recess can be not-only polygon or non-uniform, but could also be conical or cylindrical since the locking features inhibit the relative rotation between the nut and the recess.

Figure 9:
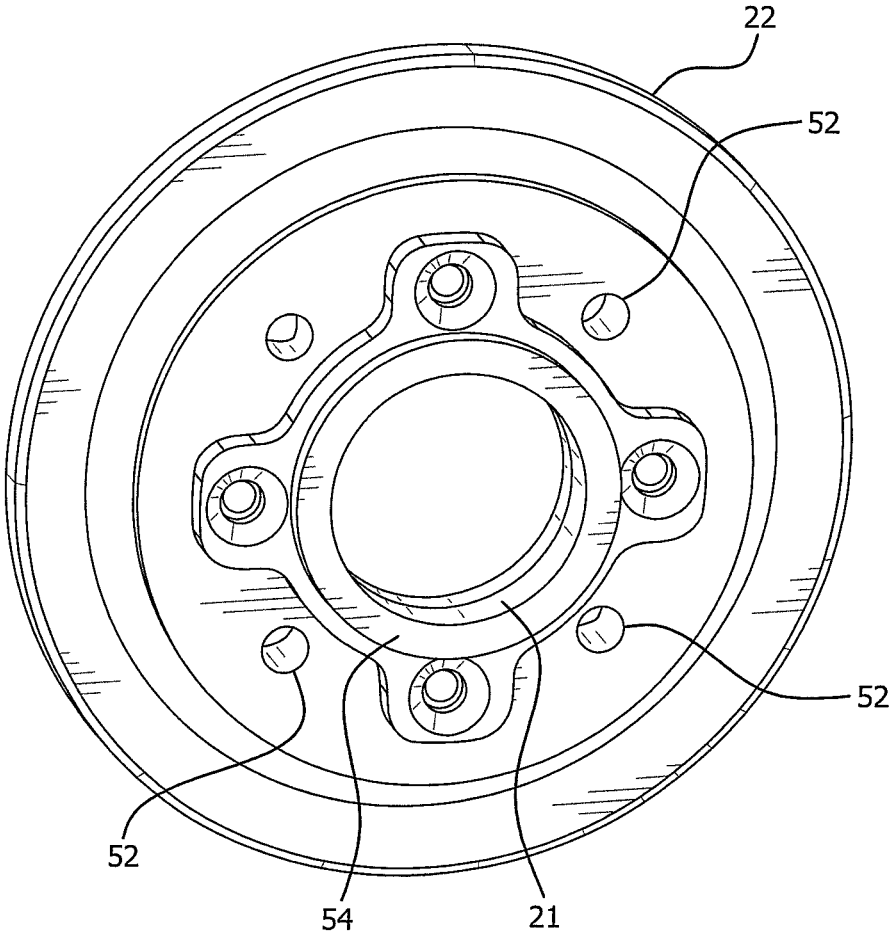
FIG. 9 is a rear perspective view of the backing pad core of FIG. 8.

In the illustrated embodiment, the pins project away from the face 30 of the nut 18 and are located close to the corners. The pins have a length that is longer than the thickness D3 of the nut 18. A center boss 54 (shown in FIG. 9) may also be added to facilitate centering and aligning the nut 18. The outer diameter of the center boss 54 must be less than the diameter of the hole 38 in the RFD 12. The alignment holes 52 are formed in the corners of the recess 20 as shown so that the pins align with and slide into the holes during installation. Of course, it should be apparent that the pins 50 and alignment holes 52 can be located at alternate positions to those shown. It should also be apparent that the use of centering pins and mating alignment holes allow for the nut and recess to have a conical shape since the pins and alignment holes will prevent the nut and recess from rotating relative to one another.

It is also contemplated that a spacer 56 can be attached to the back surface of the core 22 (FIG. 9) to space the pad 14 and RFD 12 grinding surface from the spindle end, such that when the nut 18 is tightened, the end of the spindle 16 does not protrude from the face 30 of the nut 18.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. The various embodiments and elements can be interchanged or combined in any suitable manner as necessary.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

The invention claimed is:

1. An abrasive disc mounting assembly for attaching an abrasive disc to a spindle on a rotary motor drive, the assembly comprising:

a backing pad with a front face and a rear surface, a polygon shaped tapered recess formed in the front face and extending into the backing pad, the recess having angled sides extending with an inward end and a base at the inward end of the angled sides, and a hole formed in the recess and passing through the backing pad from the base to the rear surface, the hole being centered within the recess; and a polygon shaped tapered nut having a base, angled sides and a face, the polygon shape being complementary to the polygon shape of the tapered recess such that the tapered nut is configured to seat within the tapered recess with the face of the nut located inside the recess relative to the face of the backing pad and without any portion of the tapered nut extending radially over the face of the backing pad, the nut having internal threads that are adapted to mate with threads on the spindle;

wherein the tapered nut has a plurality of alignment pins extending from a side of the nut opposite from the face of the nut, and wherein the recess includes a plurality of alignment holes formed in the base, the alignment holes positioned to align with the pins so that the pins can be inserted into the alignment holes during installation of the nut on the backing pad.

2. The mounting assembly of claim 1, wherein the tapered recess and the tapered nut are each in the shape of a truncated square pyramid.

3. The mounting assembly of claim 2, wherein the recess has an opening on the front face of the backing pad with sides of about 1.88 inches and wherein the base of the opening has sides of about 0.88 inches, and wherein the opposed sides of the tapered nut are about 1.54 inches apart on the top of the nut and about 0.88 inches apart on the bottom of the nut, and wherein when the nut is seated in the recess a face of the nut sits below the face of the backing pad.

4. The mounting assembly of claim 2, wherein opposed sides of the tapered recess define an inclusive angle of about 93.18 degrees, and wherein the opposed sides of the tapered nut define an inclusive angle of about 86 degrees and is about 0.32 inches thick.

5. The mounting assembly of claim 2, wherein the recess has an opening on the face of the backing pad with side dimensions of between approximately 1.50 inches and approximately 2.00 inches and wherein the base of the opening has side dimensions of between approximately 0.625 inches and approximately 1.00 inch, wherein the opposed sides of the tapered nut are between approximately 1.50 inches and approximately 2.00 inches apart on the top of the nut and between approximately 0.625 inches and approximately 1.00 inch apart on the bottom of the nut, and wherein opposed sides of the tapered recess define an inclusive angle of between approximately 45 degrees and approximately 155 degrees, and wherein the opposed sides of the tapered nut define an inclusive angle of between approximately 45 degrees and approximately 155 degrees, and is about 0.32 inches thick.

6. The mounting assembly of claim 1, wherein the tapered nut is made from metal, plastic or composite material.

7. An abrasive disc mounting assembly for attaching an abrasive disc to a spindle on a rotary motor drive, the assembly comprising:

a backing pad with a front face and a rear surface, a polygon shaped tapered recess formed in the front face and extending into the backing pad, the recess having angled sides extending with an inward end and a base at the inward end of the angled sides, and a hole formed in the recess and passing through the backing pad from the base to the rear surface, the hole being centered within the recess; and a polygon shaped tapered nut having a base, angled sides and a face, the polygon shape being complementary to the polygon shape of the tapered recess such that the tapered nut seats within the tapered recess with the face of the nut located inside the recess relative to the face of the backing pad, the nut having internal threads that are adapted to mate with threads on the spindle; and an abrasive resin fiber disc mounted to the backing pad with the tapered nut, the disc having abrasive material disposed on one side, the disc having a hole formed through the disc with a plurality of slits cut into the disc and extending generally away from the hole, the slits defining tabs spaced around the hole, wherein when the nut is threaded onto the spindle and in the recess, the tabs are located between the sides of the nut and the sides of the recess thereby securing the disc to the backing pad.

8. An abrasive disc mounting assembly for attaching an abrasive disc to a spindle on a rotary motor drive, the assembly comprising:

a backing pad with a front face and a rear surface, a polygon shaped tapered recess formed in the front face and extending into the backing pad, the recess having angled sides extending with an inward end and a base at the inward end of the angled sides, and a hole formed in the recess and passing through the backing pad from the base to the rear surface, the hole being centered within the recess; and a polygon shaped tapered nut having a base, angled sides and a face, the polygon shape being complementary to the polygon shape of the tapered recess such that the tapered nut is configured to seat within the tapered recess with the face of the nut located inside the recess relative to the face of the backing pad and without any portion of the tapered nut extending radially over the face of the backing pad, the nut having internal threads that are adapted to mate with threads on the spindle;

wherein the backing pad includes a pad core made from a rigid material surrounded by an annular flexible ring with a portion of the ring defining a portion of the face of the backing pad; and wherein the ring includes raised support ridges that extend radially outward along the face of the ring from an inner portion of the ring to an outer portion.

9. The mounting assembly of claim 8, wherein the pad core is made from metal, plastic or composite material.

10. The mounting assembly of claim 8, wherein the tapered recess is formed in the pad core.

11. The mounting assembly of claim 8, wherein the ridges are curved in a direction away from the intended direction of rotation of the assembly during use.

12. An abrasive disc mounting assembly for attaching an abrasive disc to a spindle of a rotary motor drive, the assembly comprising:

a backing pad with a front face and a rear surface, the backing pad including a rigid pad core portion surrounded by an annular flexible ring portion, the ring portion defining a portion of the face of the backing pad, a polygon shaped tapered recess formed in the pad core portion on the front face side of the backing pad, the tapered recess having angled sides that extend into the pad core portion and having a base at an inward end of the angled sides, and a hole formed in the recess and passing through the pad core portion from the base to the rear surface, the hole being centered within the recess, the angled sides of the tapered recess each form an angle relative to a center axis of between approximately 22.5 degrees and 77.5 degrees;

a polygon shaped tapered nut having a base, angled sides and a face, the polygon shape being complementary to the polygon shape of the tapered recess such that the tapered nut is configured to seat within the tapered recess with the face of the nut located inside the recess relative to the face of the backing pad and without any portion of the tapered nut extending radially over the face of the backing pad, the nut having internal threads that are adapted to mate with the threads on the spindle, the angled sides of the tapered nut each form an angle relative to a center axis of between approximately 22.5 degrees and 77.5 degrees; and an abrasive resin fiber disc removably mountable to the backing pad with the tapered nut, the disc having abrasive material disposed on one side, the disc having a hole formed through it with a plurality slits extending generally away from the hole, the slits defining tabs spaced around the hole, wherein when the nut is threaded onto the spindle and in the recess, the tabs are located between the sides of the nut and the sides of the recess thereby securing the disc to the backing pad.

13. The mounting assembly of claim 12, wherein the tapered nut has a plurality of alignment pins extending from a side of the nut opposite from the face of the nut, and wherein the recess includes a plurality of alignment holes formed in the base or tapered sides, the alignment holes positioned to align with the pins so that the pins can be inserted into the alignment holes during installation of the nut on the backing pad.

14. The mounting assembly of claim 13, wherein the pad core and the ring are two separate components and wherein the pad core is made from metal, plastic or composite material.

15. The mounting assembly of claim 13, wherein the pad core and the ring are formed as a unitary component.

16. The mounting assembly of claim 14, wherein the tapered nut is made from metal, plastic or composite material.

17. An abrasive disc mounting assembly for attaching an abrasive disc to a spindle of a rotary motor drive, the assembly comprising:

a backing pad with a front face and a rear surface, the backing pad including a rigid pad core portion surrounded by an annular flexible ring portion, the ring portion defining a portion of the face of the backing pad, a tapered recess formed in the pad core portion on the front face side of the backing pad, the tapered recess having angled sides that extend into the pad core portion and a base at #s an inward end of the angled sides, and a hole formed in the recess and passing through the pad core portion from the base to the rear surface, the hole being centered within the recess, the angled sides of the tapered recess each form an angle relative to a center axis of between approximately 22.5 degrees and 77.5 degrees; and a tapered nut having a base, angled sides and a face, the shape of the tapered nut being complementary to the shape of the tapered recess such that the tapered nut is configured to seat within the tapered recess with the face of the nut located inside the recess relative to the face of the backing pad, the nut having internal threads that are adapted to mate with the threads on the spindle, the angled sides of the tapered nut each form an angle relative to a center axis of between approximately 22.5 degrees and 77.5 degrees, wherein the tapered nut has a plurality of alignment pins extending from a side of the nut opposite from the face of the nut, and wherein the recess includes a plurality of alignment holes formed in the base or tapered sides, the alignment holes positioned to align with the pins so that the pins can be inserted into the alignment holes during installation of the nut on the backing pad.

18. An abrasive disc mounting assembly for attaching an abrasive disc to a spindle on a rotary motor drive, the assembly comprising:

a backing pad with a front face and a rear surface, a recess formed in the front face and extending into the backing pad, the recess having sides with an inward end, a base at the inward end of the sides, and a hole formed in the recess and passing through the backing pad from the base to the rear surface, the hole being centered within the recess;

a nut having a base, sides and a face, the shape of the nut being complementary to the shape of the recess such that the nut is configured to seat within the recess with the face of the nut located inside the recess relative to the face of the backing pad and without any portion of the tapered nut extending radially over the face of the backing pad, the nut having internal threads that are adapted to mate with threads on the spindle; and wherein the nut and the recess include mating anti-rotational features, the anti-rotational features prevent relative rotation between the nut and the recess thereby providing a defined way for the nut to mate with the recess, the anti-rotational features including at least one pin and at least one mating hole, wherein one of the at least one pin and at least one hole is on the nut and the other of the at least one pin and at least one hole is on the recess.

19. The mounting assembly of claim 18 wherein the anti-rotational features are polygon-shaped sides on the nut and recess.

20. The mounting assembly of claim 18 wherein the anti-rotational features are non-uniform shaped sides on nut and recess.

21. The mounting assembly of claim 18 wherein the anti-rotational features are a key and a mating slot, one of the key and slot being formed on the side of the nut and the other of the key or the slot being formed on the side of the recess.

22. The mounting assembly of claim 7, wherein the tapered recess and the tapered nut are each in the shape of a truncated square pyramid.

23. The mounting assembly of claim 7, wherein the recess has an opening on the front face of the backing pad with sides of about 1.88 inches and wherein the base of the opening has sides of about 0.88 inches, and wherein the opposed sides of the tapered nut are about 1.54 inches apart on the top of the nut and about 0.88 inches apart on the bottom of the nut, and wherein when the nut is seated in the recess a face of the nut sits below the face of the backing pad.

24. The mounting assembly of claim 7, wherein opposed sides of the tapered recess define an inclusive angle of about 93.18 degrees, and wherein the opposed sides of the tapered nut define an inclusive angle of about 86 degrees and is about 0.32 inches thick.

* * * * *